US005372199A

United States Patent [19]

Cegielski et al.

[11] Patent Number: 5,372,199

[45] Date of Patent: Dec. 13, 1994

[54] SUBSEA WELLHEAD

[75] Inventors: Eugene J. Cegielski; Robert L. Wilkins, both of Houston, Tex.

[73] Assignee: Cooper Industries, Inc., Houston, Tex.

[21] Appl. No.: 18,065

[22] Filed: Feb. 16, 1993

[51] Int. Cl.[5] ..... E21B 33/035

[52] U.S. Cl. ..... 166/368; 166/381; 166/85

[58] Field of Search ..... 166/85, 348, 344, 368

[56] References Cited

U.S. PATENT DOCUMENTS

| | | | |
|---|---|---|---|
| 4,089,377 | 5/1978 | Chateau | 166/85 X |
| 4,154,298 | 5/1979 | Gano | 166/85 |
| 4,289,206 | 9/1981 | Kirkland | 166/348 |
| 4,651,831 | 5/1987 | Baugh | 166/344 |
| 4,691,781 | 9/1987 | Gano | 166/368 |
| 4,736,799 | 4/1988 | Ahlstone | 166/348 |
| 4,749,046 | 6/1988 | Gano | 166/368 |
| 4,938,289 | 7/1990 | Van Bilderbeek | 166/368 |

FOREIGN PATENT DOCUMENTS 92305014.0 6/1992 European Pat. Off. .

*Primary Examiner*—Ramon S. Britts
*Assistant Examiner*—Frank S. Tsay

[57] ABSTRACT

The present invention relates to an improved subsea wellhead and to the method of retrieving the production string from the wellhead and the method of retrieving the tree from the wellhead. The wellhead includes a lower tubing hanger landing within the wellhead housing and an upper false tubing hanger landed within the tree. The upper false tubing hanger includes preps for receiving two plugs within its central bore above the radial bore through the upper tubing hanger which communicates with the radial bore through the tree through which production fluids flow from the well. A tubular member extends from the upper false tubing hanger to the lower tubing hanger and defines the flow passage through which production fluids flow between the two hangers. A sleeve surrounds the exterior of the tubular member and contains fluids communicated to the interior of the sleeve from the annulus surrounding the tubing string. Orienting means is provided to orient the upper false tubing hanger as it is being landed within the tree so that the radial passages in the upper false tubing hanger and the tree are in registry.

10 Claims, 5 Drawing Sheets

SUBSEA WELLHEAD

BACKGROUND

The present invention relates to an improved subsea wellhead in which either the production string or the production tree may be easily and quickly recovered from their subsea location and readily reinstalled without the excessive loss of downtime normally associated with such operations.

Prior to the present invention, the removal of either of the production tubing or the production tree from a subsea well could only be accomplished by utilizing the steps of their installation in the reverse order for recovery. This entails substantial equipment for the removal of the tree and for the removal of the tubing string. None of the known prior art allowed the easy removal of the production tree in any manner.

One of the closest known prior art is the European Patent Specification, Application No. 92305014.0, filed by Cooper Industries, Inc. on Jun. 1, 1992, having inventors named: Thomas Gus Cassity and Hans Paul Hopper and entitled "Wellhead." This application discloses an improved wellhead in which the production tubing and tubing hanger can be retrieved without pulling the production tree. This art, however, requires that the production tubing be pulled prior to pulling the tree. There is no suggested structure or steps by which the tree can be removed, without first removing the production tubing, other than by the extended procedure which reverses its installation process.

SUMMARY

The present invention relates to an improved subsea wellhead in which the production string may be quickly and easily removed, or the production tree may be quickly and easily removed, each independent of the other. The structure includes the wellhead housing with the casing hangers supporting the casing strings landed in the housing, a tree connected to the upper end of the wellhead housing, an upper false tubing hanger landed in the tree and having communication with the production line extending radially out of the tree, a tubular member extending downwardly therefrom, an orienting lip extending downwardly therefrom and a sleeve extending downwardly around the exterior of the orienting lip and tubular member, and a lower tubing hanger landed within the inner casing hanger and having the production tubing string extending downwardly therefrom and an internal preparation for a sealing plug and any other downhole devices desired. With the two casing hangers, the production string can still be sealed with a plug when the upper hanger is removed and the tree is removed. In addition with this structure the complete production tubing string including both tubing hangers may be quickly and easily retrieved from the well and replaced therein.

An object of the present invention is to provide an improved subsea wellhead in which either the production string or the production tree may be easily and quickly removed.

A further object is to provide an improved method of retrieving a tree from a subsea well without having to remove the production tubing.

Still another object is to provide an improved method of retrieving the production string and/or the production tubing from a subsea well quickly and easily with only a blowout preventer, and without having to remove the tree.

BRIEF DESCRIPTION OF THE DRAWINGS

These and other objects and advantages of the present invention are hereinafter set forth and explained with reference to the drawings wherein:

FIG. 2A is the upper portion of the structure, FIG. 2B is the intermediate portion of the structure and FIG. 2C is the lower portion of the structure. FIG. 2D is also the lower portion of the structure with a wellhead seal cap installed.

DESCRIPTION OF THE PREFERRED EMBODIMENTS

Figure 1:
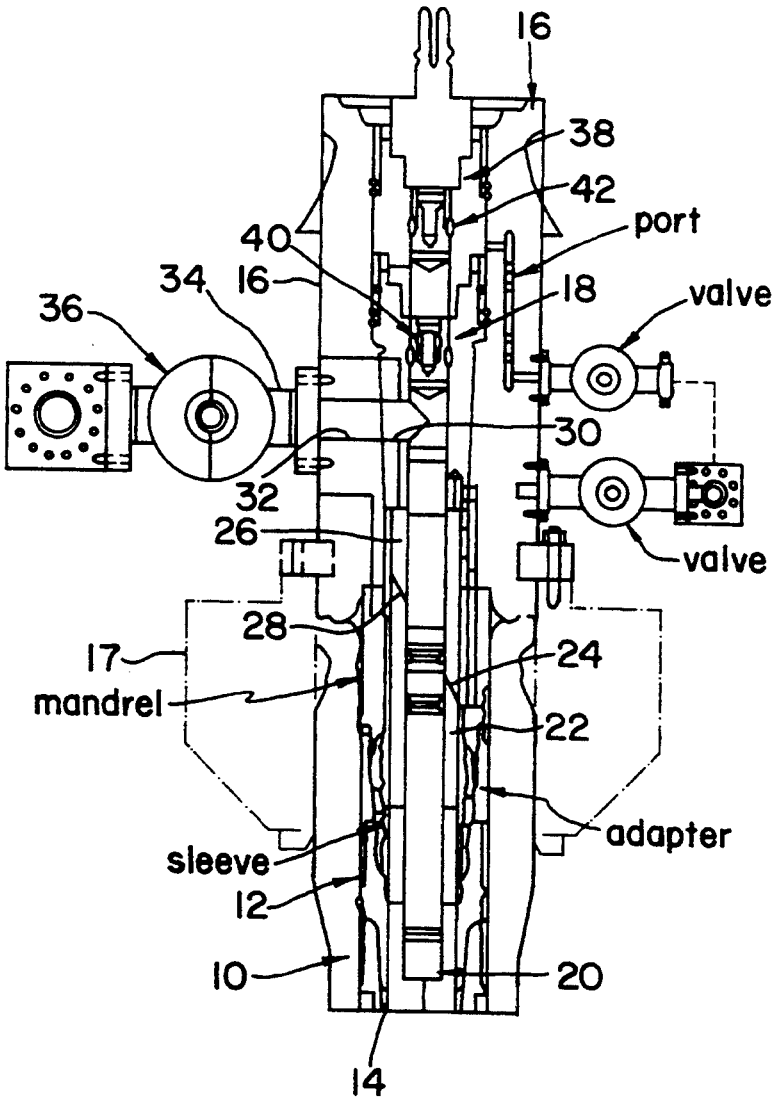
FIG. 1 PRIOR ART
FIG. 1 is a schematic illustration of the prior art subsea wellhead structure with the production tree installed thereon and the production string installed therein.

As shown in FIG. 1, the subsea wellhead of the prior art includes housing 10 having casing hanger 12 landed therein and supporting casing string 14 extending downwardly from hanger 12. Tree 16 is suitably connected to the upper end of housing 10 by remote operated connector 17 and production tubing hanger 18 is landed therein with production tubing 20 extending downwardly therefrom. Locating member 22 is supported within tree housing 10 and engages casing hanger 12 and has an upper helix surface 24 which coacts with lower helix surface 26 on tubular member 28 extending downward from tubing hanger 18 to ensure the proper orientation of tubing hanger 18 within tree 16 so that port 30 through the side of tubing hanger 18 registers with port 32 which extends through tree 16 and communicates with external production connection 34 which is under the control of valve 36. Isolation cap 38 is landed within tree 16, plug 40 is landed in hanger 18 immediately above port 30 and plug 42 is landed in isolation cap 38 so that production is directed out through ports 30 and 32 and through connection 34 and valve 36.

With the components positioned as shown in FIG. 1, production through tubing string 20 is under the control of valve 36 and the annulus pressure is under control of isolation cap 38 which is sealed within tree 16. In order to pull the production string, it is only necessary to lower and secure a suitable blowout preventer to the upper end of tree 16 and then remove isolation cap 38 and tubing hanger 18 with tubing string 20 secured thereto from the well. During these operations the well is under the control of the blowout preventer. Since the subsea apparatus shown in FIG. 1 does not include a separate tubing hanger supported within the well at a point below the tree, the recovery of the tree from the subsea well is only possible with the extended and complicated procedures of the prior art which are necessary to maintain control of the well during these operations.

Figure 2A:
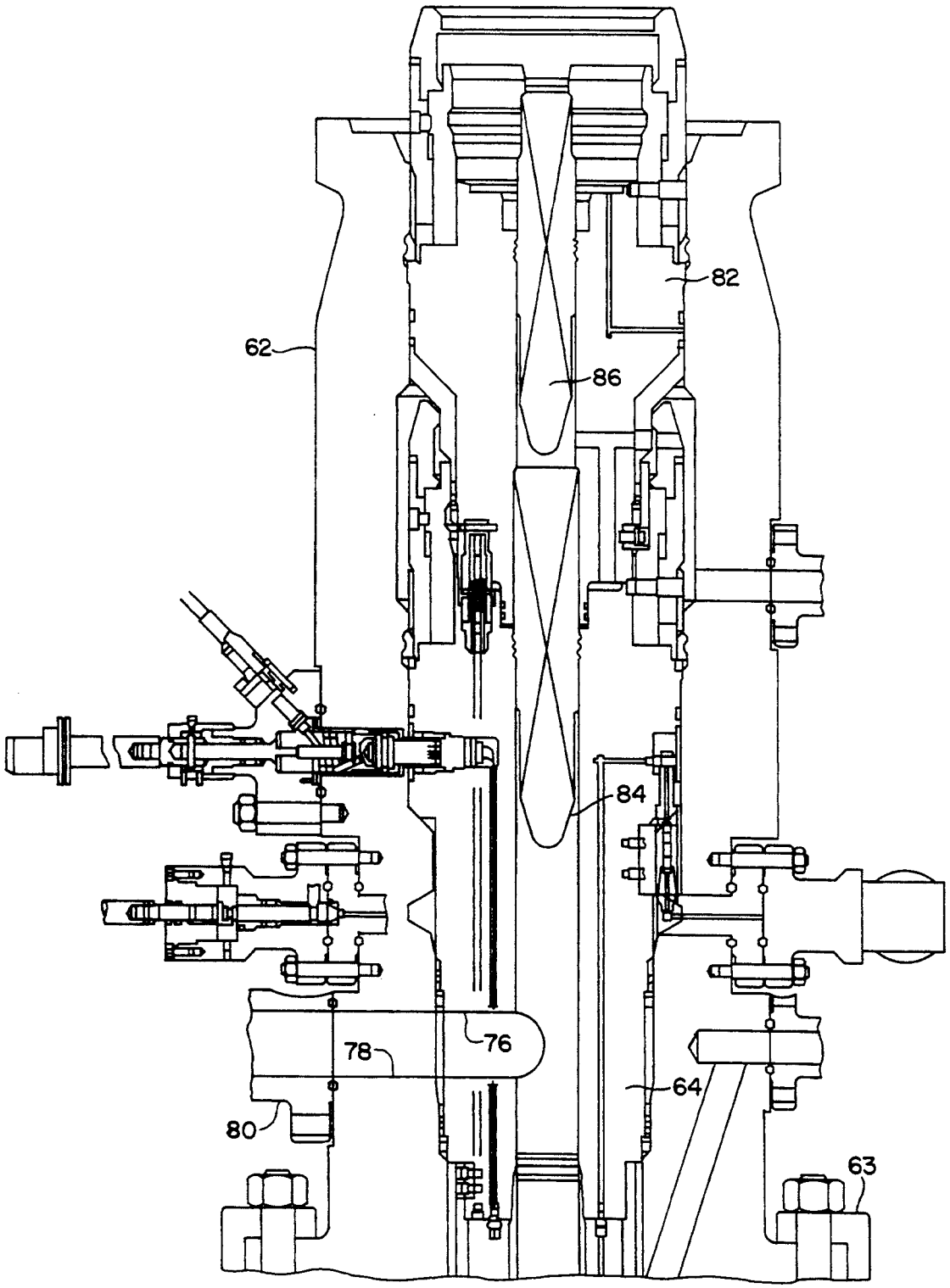
FIGS. 2A, 2B, 2C and 2D are a series of vertical sectional views of the wellhead housing with a hanger cap installed therein above the production tubing and tubing hanger.
Figure 2B:
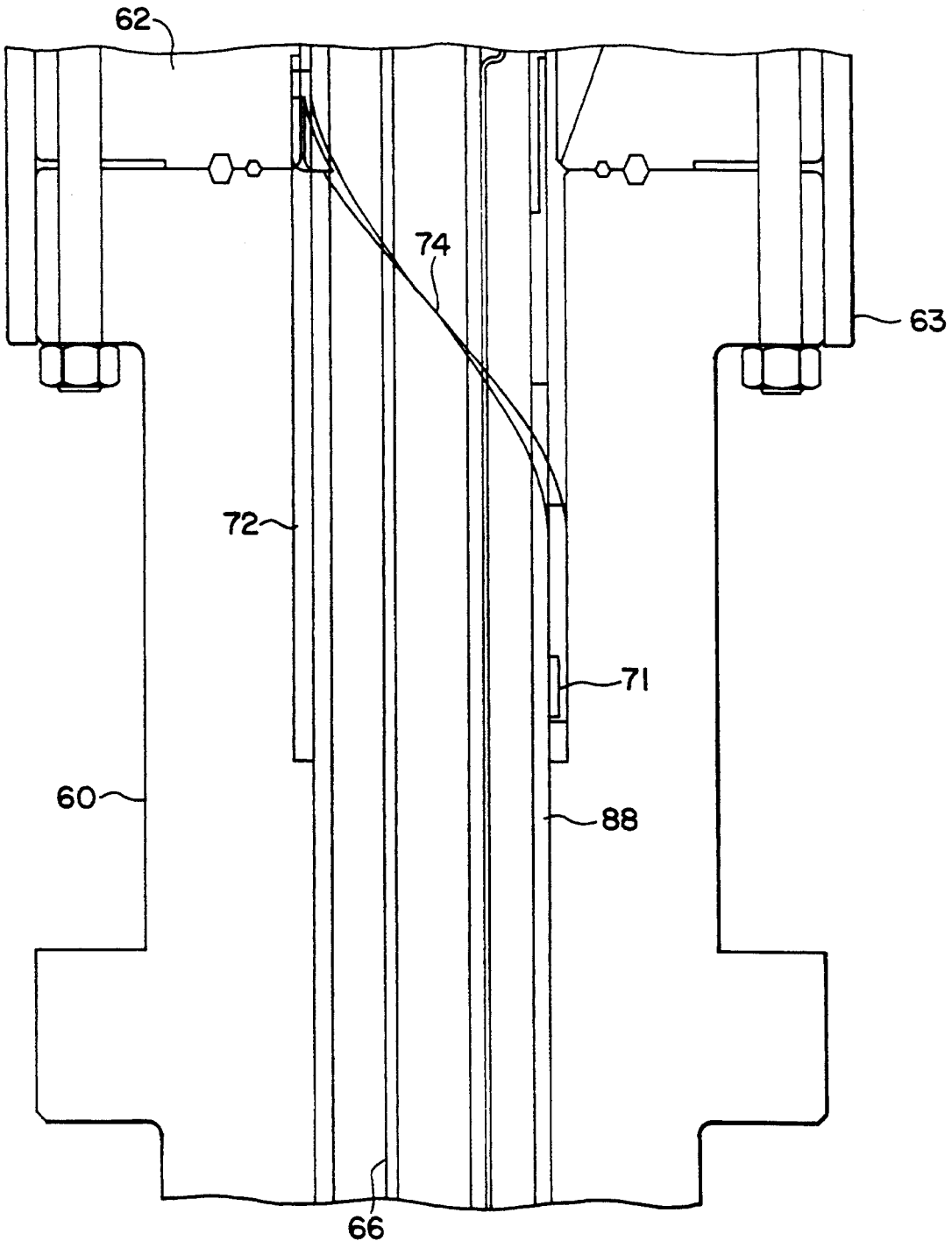
Figure 2C:
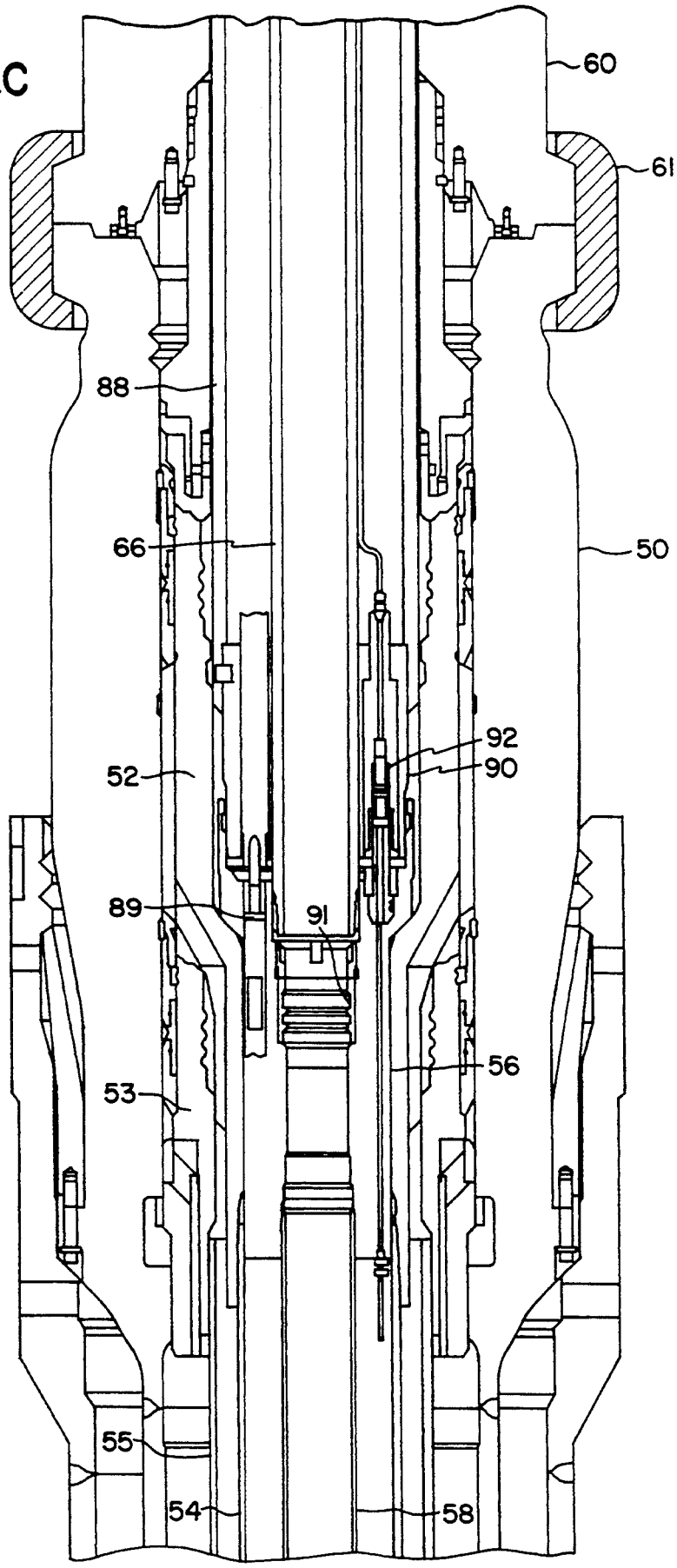
Figure 2D:
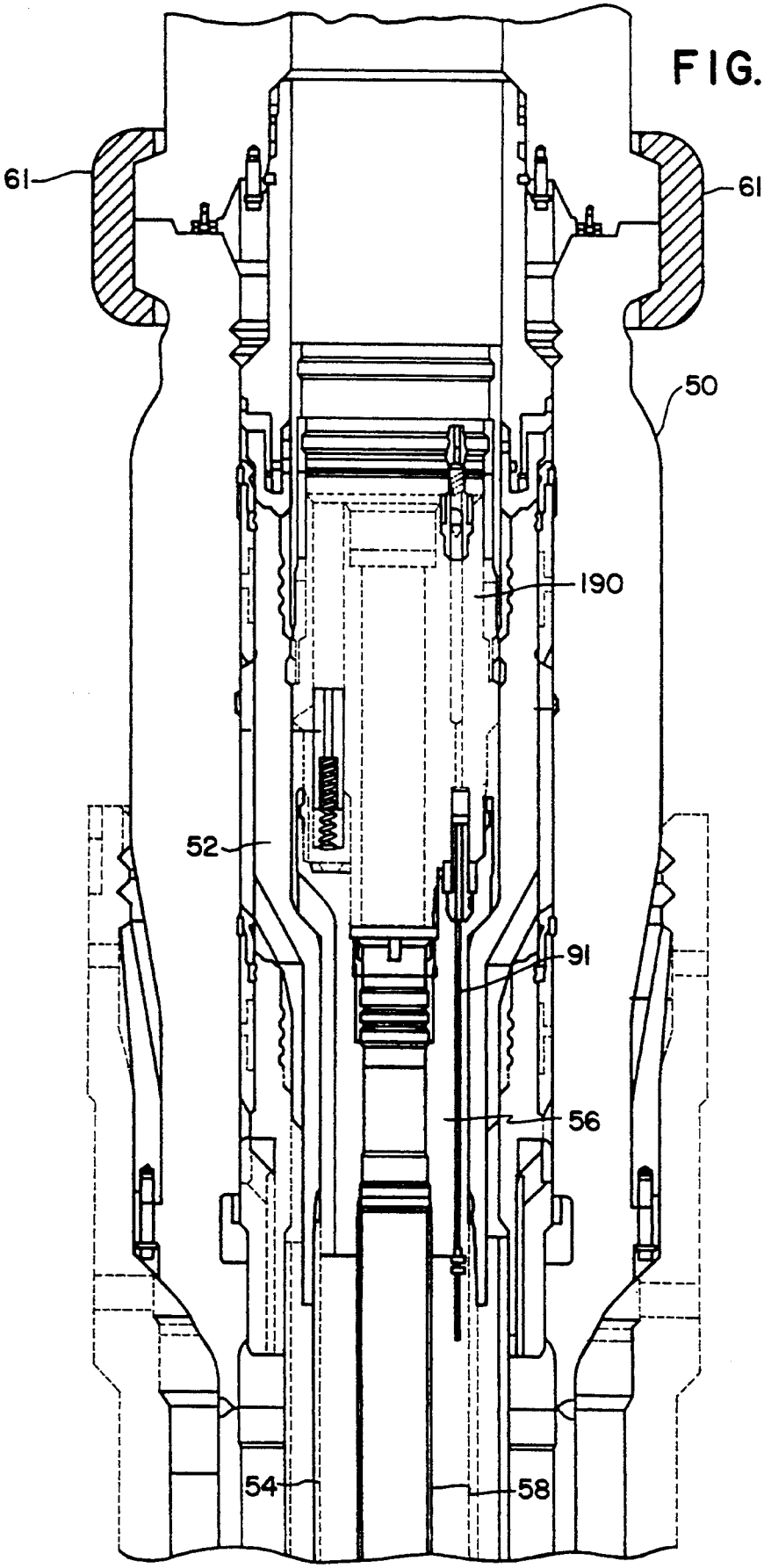

Wellhead housing 50, as shown in FIGS. 2A, 2B and 2C, has casing hangers 52 and 53 landed therein with the casing strings 54 and 55 extending down into the well from the hangers 52 and 53. Lower tubing hanger 56 is landed within casing hanger 52 and supports tubing string 58 which extends downwardly from the lower end thereof.

Tree sub 60 is landed and secured by clamp 61 to the upper end of housing 50 and tree 62 is landed on and secured to the upper end of tree sub 60 by clamp 63. Clamp 61 is a remotely operated clamp so that it may be released when tree 62 is to be removed. Upper false tubing hanger 64 is landed within tree 62 as shown and includes tubular member 66 threaded into its lower opening and sleeve 88 attached to the exterior of its lower end having orienting key 71 mounted to its exterior surface. Tubular member 66 extends downwardly and seals within lower tubing hanger 56. Tubular orienting member 72 is mounted within tree sub 60 and includes upper helix surface 74 which receives key 71 to cause the upper hanger 64 to rotate so that port 76 in upper hanger 64 registers with port 78 in tree 62 allowing production flow from tubing string 58 to flow therethrough into suitable production lines 80 with suitable valving (not shown). When ready for production, upper cap 82 is secured and sealed within the upper end of tree 62 and includes a central bore registering with the central bore of upper tubing hanger 64 and having a configuration to allow lower plug 84 to be seated and sealed within upper tubing hanger 64 and to allow upper plug 86 to be seated and sealed within the central bore of upper cap 82. Lower tubing hanger 56 includes optional electrical connector 89 for use in communicating with a downhole electrical device, such as a pressure transducer. A hydraulic control line coupling 92 is provided to allow communication to a downhole safety valve. Tubing hanger 56 also includes an orienting pin (not shown) located approximately 90° from control line coupling 92 and pointing vertically upward to engage the lower end of hanger cap 90 to ensure proper axial alignment of the entire assembly when it is returned to the wellhead after having ben removed.

When it is desired to recover the production tubing string 58, any suitable blowout preventer may be installed on the upper end of tree 62 to place the well under control and then upper cap 82 is released and recovered through the blowout preventer. With upper cap 82 removed a suitable tool is run to engage and recover upper tubing hanger 64 including tubular member 66 and sleeve 88 with orienting key 71 attached thereto. Thereafter, a tool is run into engagement with lower tubing hanger 56, which has tubing string 58 suspended therefrom, and it is recovered from the wellhead housing 50. With the production tubing and tubing hangers removed from the wellhead housing 50 any desired work or change in equipment may be performed in the well and then the production tubing and tubing hangers are again set in the wellhead housing 50.

In the event that it is desired that tree 62 be removed from the wellhead without removing the production tubing, a suitable blowout preventer is connected to the upper end of tree 62. With the blowout preventer in place, upper cap 82 is engaged and retrieved. Then upper tubing hanger 64 with upper tubular member 66, sleeve 88 and hanger cap 90 attached thereto, is engaged and retrieved. As shown in FIG. 4, a suitable wellhead seal cap 190 is secured within lower tubing hanger 56 to control the production string and the casing annulus. If desired, a wireline plug may be seated within the wireline prep 91 in the production bore of tubing hanger 56. This seals the production bore and annulus. With the well under control, the blowout preventer can be removed and then tree 62 is removed. After all operations planned for the well while tree 62 is removed, tree 62 is returned and connected to the upper end of tree sub 60 and after the blowout preventer has been connected to the upper end of tree 62. The wellhead seal cap 190 is recovered and then the remainder of the production equipment is reinstalled.

In the event that both the tree 62 and the production tubing string 58 are to be retrieved, then its is suggested that the tubing string 58 should be recovered as set forth above and a suitable plug is set in the inner casing hanger to close the well and thereafter, the tree 62 and tree 60 can be released and retrieved by remotely releasing clamp 61 and recovering them to the surface.

It should be noted that tree sub 60 is used primarily only in subsea guidelineless completions where it is desirable to elevate tree 62 above the upwardly facing funnel typically installed about the wellhead housing 50 and thereby, gain clearance for the production flowlines. In a typical guideline completion, tree sub 60 and clamp 63 would not be used. The lower end of tree 62 would be slightly longer and connected directly to the upper end of housing 50 by claim 61. Tubular member 66 and sleeve 88 would both be substantially shorter.

From the foregoing, it can be seen that the present invention provides an improved subsea wellhead in which either the production equipment within the well may be safely and quickly removed from within the tree or the production equipment may remain in the well bore and the tree retrieved from the wellhead housing. Maintenance to either the downhole production equipment or the seabed tree can be performed independently without the requirement to retrieve both.

What is claimed is:

1. A subsea wellhead completion system comprising:

a wellhead housing having a lower internal bore and adapted to be supported on a seabed;

a tree disposed above said wellhead housing and having an upper internal bore;

connecting means for connecting said tree to said wellhead housing such that said upper internal bore communicates with said lower internal bore;

an upper hanger disposed in said upper internal bore, an upper production bore extending through said upper hanger;

a lower hanger disposed in said lower internal bore below said upper hanger and having a production tubing string extending downwardly therefrom, said lower hanger having a lower production bore extending therethrough, a lower end of said lower production bore communicating with an upper end of said production tubing string and with a lower end of said upper production bore, said lower hanger including means for receiving first closing means for closing said lower production bore;

said tree including a radial production port for communicating said upper production bore with an external production line;

orienting means for orienting said upper hanger to a preselected position for communicating said upper production bore with said radial production bore;

said upper hanger including means for receiving second closing means for closing said upper production bore at a location above said radial production bore; and a removable cap for closing an upper end of said upper internal bore.

2. A subsea wellhead completion system according to claim 1, wherein said upper hanger is movable vertically relative to said lower hanger and is removable from said upper internal bore when said cap is removed and when said first closing means closes said lower production bore, to enable said tree to be disconnected from said wellhead housing.

3. A subsea wellhead completion system according to claim 2, wherein said upper and lower hangers are movable vertically through said upper internal bore and out of said tree when said cap is removed.

4. A subsea wellhead completion system according to claim 1, wherein said upper and lower hangers are movable vertically through said upper internal bore and out of said tree when said cap is removed.

5. A subsea wellhead completion system according to claim 1 further including radially inner and outer casing hangers supported within said lower internal bore, said lower hanger being supported on said radially inner casing hanger.

6. A method of servicing a subsea well, said well comprising a wellhead housing supported on a seabed; a tree disposed above said wellhead housing and removably connected thereto; an upper hanger landed within said tree; a lower hanger landed within said wellhead housing; said lower hanger including a lower production bore extending therethrough; said upper hanger including an upper production bore extending therethrough; a lower end of said upper production bore communicating with an upper end of said lower production bore; said tree including a radial passage communicating with said upper production bore, said method comprising the steps of:

A) setting a blowout preventer on an upper end of said tree;

B) removing said upper hanger from within said tree;

C) closing said lower production bore;

D) removing said blowout preventer from said tree; and

E) removing said tree from said wellhead housing.

7. The method according to claim 6 further including the steps of:

F) re-connecting said tree to said wellhead housing;

G) connecting a blowout preventer to an upper end of said tree;

H) opening said lower production bore;

I) landing said upper hanger in said tree, with said radial passage communicating with said upper production bore;

J) closing said upper production bore at a location above said radial passage; and K) retrieving said blowout preventer.

8. A method of servicing a subsea well, which well comprising a wellhead housing supported on a seabed; a tree disposed above said wellhead housing and removably connected thereto; an upper hanger landed within said tree; a lower hanger landed within said wellhead housing; a tubing string extending downwardly from said lower hanger; said lower hanger including a lower production bore extending therethrough; said upper hanger including an upper production bore extending therethrough; a lower end of said upper production bore communicating with an upper end of said lower production bore; said tree including a radial passage communicating with said upper production bore, said method comprising the steps of:

A) setting a blowout preventer on an upper end of said tree;

B) removing said upper hanger from said tree; and

C) removing said lower hanger and said tubing string from both said wellhead housing and said tree.

9. The method according to claim 8 further including, prior to step B, the step of removing a cap from an upper end of said tree to permit said upper and lower hangers to be removed from said tree.

10. The method according to claim 8 further comprising the steps of:

D) landing said lower hanger in said wellhead housing, with said tubing string extending downwardly from said lower hanger;

E) landing said upper hanger in said tree to communicate said upper production bore with said lower production bore;

F) setting closure means in said upper production bore to close said upper production bore at a location above said radial passage; and G) setting a cap on an upper end of said tree.

* * * * *